United States Patent [19]

Buer et al.

[11] Patent Number: 4,465,195

[45] Date of Patent: Aug. 14, 1984

[54] METHOD OF SORTING AND COUNTING CANS

[76] Inventors: Jeffrey J. Buer, 4705 Lakewood Dr., Lakewood, Iowa 50211; John P. Williams, 6833 Golden La., Des Moines, Iowa 50313

[21] Appl. No.: 345,802

[22] Filed: Feb. 4, 1982

[51] Int. Cl.[3] ..... B07C 7/04

[52] U.S. Cl. ..... 209/704; 209/551

[58] Field of Search ..... 209/704, 522, 551, 942, 209/703, 705

[56] References Cited

U.S. PATENT DOCUMENTS

| | | | |
|---|---|---|---|
| 314,749 | 3/1885 | Syme | 209/704 |
| 1,444,359 | 2/1923 | Rand | 209/704 |
| 1,473,365 | 11/1923 | Vogel | 209/704 |
| 3,327,942 | 6/1967 | Blume | 209/551 |
| 3,415,372 | 12/1968 | Drace | 209/704 |

FOREIGN PATENT DOCUMENTS

| | | | |
|---|---|---|---|
| 162214 | 9/1953 | Australia | 209/704 |

*Primary Examiner*—Robert B. Reeves
*Assistant Examiner*—Donald Hajec
*Attorney, Agent, or Firm*—Zarley, McKee, Thomte, Voorhees & Sease

[57] ABSTRACT

The device for sorting and counting a plurality of cans comprises a circular table having a rotatable circular floor and a fixed side wall. Attached around the periphery of the side wall are a plurality of counting tubes, each of which includes a photo-electric cell therein for sensing the number of cans which pass through the tube. Each photo-electric cell is connected to a counter on a display device which records and displays the number of cans passing through each tube. One counter totals all of the cans passing through all of the tubes.

1 Claim, 5 Drawing Figures

METHOD OF SORTING AND COUNTING CANS

BACKGROUND OF THE INVENTION

This invention relates to an improved device for sorting and counting a plurality of cans.

Many states have enacted can and bottle deposit laws which require merchandisers to charge a deposit for each beverage can and bottle sold. When the contents of the can or bottle have been emptied, the customer returns the can or bottle to the retail outlet and receives a return deposit.

The cans and bottles are then collected and taken to a central location where they are sorted and counted. Then appropriate credits are given to the retail outlets by each of the various manufacturers of the beverages.

One task which must be accomplished at the central location is the sorting and counting of the cans. This requires sorting the cans by manufacturer and tallying the number of cans returned for each manufacturer. Once this has been done, then the manufacturer can give the appropriate credit amount to the retail outlet from which the cans came.

Therefore, a primary object of the present invention is the provision of an improved device for sorting and counting a plurality of cans which are comprised of several categories.

A further object of the present invention is the provision of a device which provides swift and accurate means for sorting and counting the cans.

A further object of the present invention is the provision of a device which permits a large number of cans to be sorted and counted at once.

A further object of the present invention is the provision of a device which is economical to manufacture, durable in use and efficient in operation.

SUMMARY OF THE INVENTION

The present invention utilizes a circular table having a rotatable bottom wall therein. The bottom wall is cone-shaped with the highest point at the center, and the lowest point at the outer peripheral edges. This causes the cans to move by gravity toward the outer peripheral edge.

Around the outer peripheral edge of the table are a plurality of tubes into which operators may place the cans. These tubes include photo-electric cells therein which sense each time a can passes through the tube, and which transmits this information to an electrical counter display which displays the number of cans which have passed through that particular tube. By sorting the cans so that all cans of a particular kind are deposited in one tube, it is possible to obtain a separate count for each type of can. Each tube has a discharge end at the bottom which is adapted to deposit the can on a conveyor for carrying the cans away to be crushed and compacted.

DETAILED DESCRIPTION OF THE PREFERRED EMBODIMENT

Figure 1:
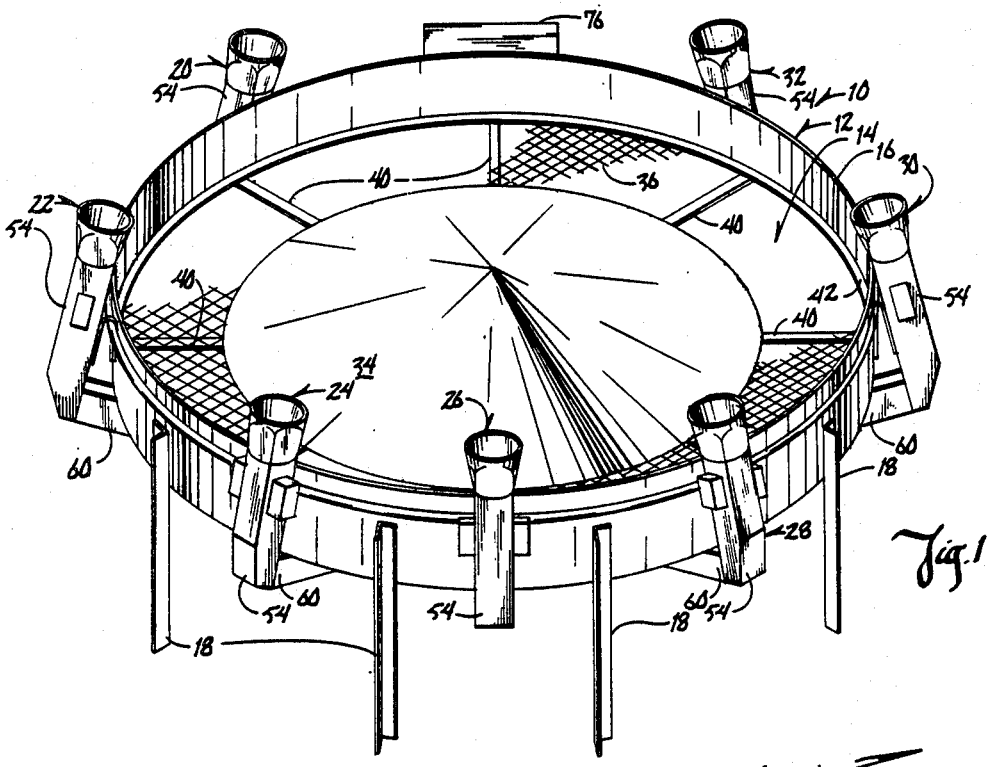
FIG. 1 is a perspective view of the can sorter counter of the present invention.

Referring to the drawings, the numeral 10 generally designates the sorting and counting device of the present invention. Device 10 comprises a circular table 12 having a rotatable bottom wall 14, and a fixed circular side wall 16. Side wall 16 is supported by a plurality of legs 18. Attached around the peripheral edge of circular wall 16 are a plurality of counting tube assemblies 20, 22, 24, 26, 28, 30 and 32.

Bottom wall 14 comprises a central cone-shaped hub 34 and a peripheral screen section 36. Extending downwardly from cone-shaped hub 34 is a downwardly presented sleeve 38. Extending radially outwardly from sleeve 38 are a plurality of spoke support members 40, each of which is welded or otherwise attached to the outer peripheral edge of cone-shaped hub 34 and also is connected at its outer radial end to a rim 42.

Sleeve 38 rotatably surrounds an upstanding post 44 which is fixed to a horizontal support plate 46, welded or otherwise secured to circular side wall 16. Thus, sleeve 38 rotates on post 44, thereby causing the entire hub 34, spokes 40, screen 36 and rim 42 to also rotate. The lower end of sleeve 38 is provided with gears 48 which are drivingly meshed with gears 50 driven by motor 52.

Figure 2:
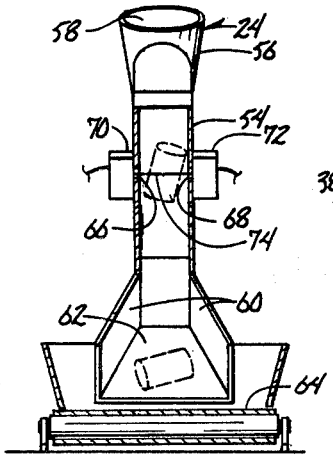
FIG. 2 is a sectional view taken along line 2—2 of FIG. 3.
Figure 3:
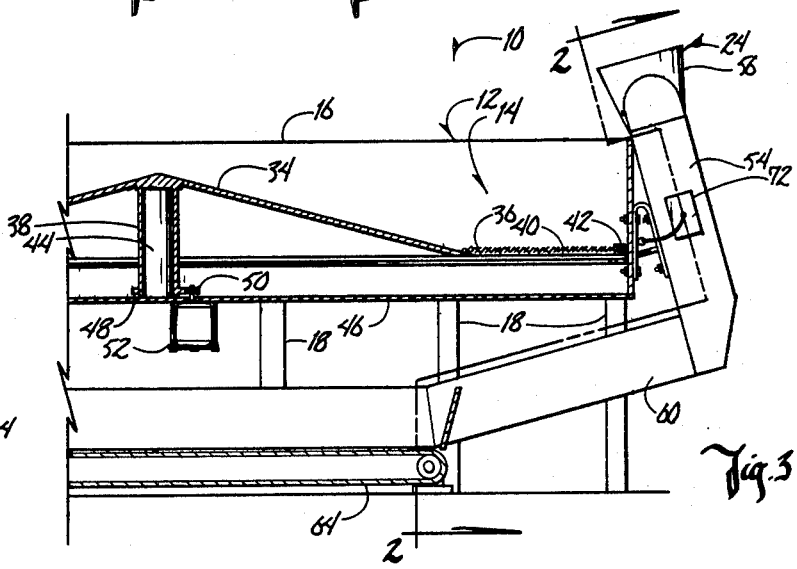
FIG. 3 is a sectional view of the table.

Each of the tubes 20–32 is identical in construction and therefore corresponding numerals are used to indicate those identical parts. Referring to FIG. 2, tube assembly 20 includes an elongated tube section 54 which is approximately rectangular in cross section. At the upper end of tube section 54 is an enlarged funnel portion 56 having an open upper end 58 for receiving cans. The lower end of tube section 54 includes a chute 60 which is angled inwardly under table 12 and which includes a discharge end 62 positioned adjacent and above a conveyor belt 64 for carrying away the cans after they have left chute 62.

Figure 5:
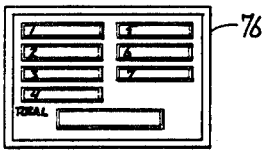
FIG. 5 is an elevational view of the counter display device.
Figure 4:
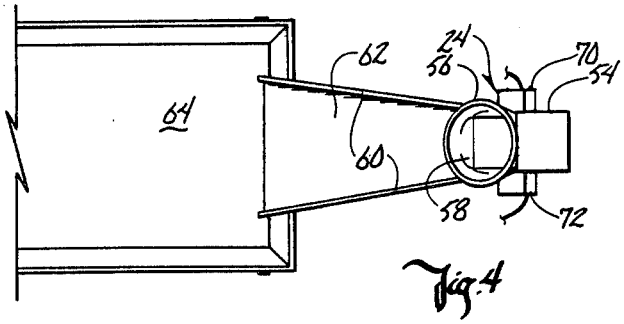
FIG. 4 is a top plan view of one of the counting tubes.

A pair of spaced apart and registered apertures 66, 68 are provided in tube section 54. Mounted over apertures 66, 68 are a pair of photo-electric cell devices 70, 72, adapted to project a photo-electric beam 74 through apertures 66, 68. Beam 74 passes through the longitudinal centerline of tube section 54 so that any can which passes through tube section 54 will interrupt the photo-electric beam. Photo-electric cells 70, 72 are connected to one of the digital display windows numbered 1 through 7, in the digital display device 76 shown in FIG. 5. Each tube assembly 20–32 is connected to a different one of the windows 1 through 7 of device 76. Each window is adapted to total the number of cans which interrupt the photo-electric beam 74 in any one of the tube assemblies 20–32.

In operation, operating personnel gather around the outer peripheral edges of table 12. The cans within table 12 fall by gravity toward the outer peripheral edges thereof due to the cone-shape of hub 34. Screen 36 permits any beverage within the cans to be drained out of the table so that there is not an accumulation of liquid within the table. The operating personnel manually pick up cans according to manufacturer or other desired sorting criteria, and place each category within a separate tube assembly. For example, tube assembly 20 may pertain to one manufacturer, tube assembly 22 may pertain to another manufacturer, and so on. As the cans are deposited in the tube section, they fall downwardly by gravity and interrupt beam 74. This causes indexing of the digital display device 76, so that every can which falls through tube section 54 is counted. The various display windows 1 through 7 display the number of cans which have fallen through each of the various tube assemblies. At the bottom of display device 76 is a total display window which totals all of the cans which have passed through all of the tube sections 20–32.

The device is simple and easy to operate. The operating personnel do not need to be concerned with mentally counting each of the various groups of cans. Instead, this is all done automatically. Indicia may be placed on each of the tube assemblies 20 to clearly indicate to the operating personnel which particular type of can must be placed in each tube assembly. Thus, it can be seen that the device provides a simple and efficient means for separating, sorting, and counting the various manufacturer's cans.

What is claimed is:

1. A method of sorting and counting a plurality of cans by employing a device including a circular table having a rotatable circular floor with a portion of said floor being of mesh screen whereby liquid drains from said floor, said floor having a center and an outer circumferential edge and being elevated adjacent said center and sloping downwardly therefrom towards said edge, a plurality of counting tubes attached to said table in spaced relation to one another around the circumference thereof, each of said tubes having an open upper inlet end and an open lower discharge end and forming a conduit along the length thereof, said tubes being slightly larger than the diameter of said cans so that said cans can pass longitudinally therethrough, a pair of apertures in each of said tubes intermediate said inlet and discharge ends and being oppositely positioned in registered alignment so that a line through their centers passes approximately through the longitudinal center of said tube, photoelectric cell means mounted on the exterior of each of said tubes and positioned over said apertures so as to project a photoelectric beam along said line therebetween, and counting means connected to said cell means for recording the number of times the continuity of said beam is broken by cans falling through said tubes, said method comprising:

introducing a plurality of cans to said floor of said table, manually sorting said cans and inserting each sorted can into said inlet end of the appropriately designated tube whereby gravity causes said can to fall through said tube and be discharged from said discharge end thereof, counting on each tube with the counting means the number of times the continuity of said beam projected across the line between said apertures by said photoelectric cell means is broken by a can falling through said tubes, displaying the number of cans falling through each of said tubes, said number of cans falling through each of said tubes being equal to the number of times said beam continuity is broken, displaying the number of cans falling through all of said tubes, said number of cans falling through all of said tubes being equal to the sum of the number of cans falling through each of said tubes, and conveying said cans away from said discharge end of said tubes.

* * * * *